US006848225B2

(12) United States Patent
Lapierre

(10) Patent No.: US 6,848,225 B2
(45) Date of Patent: Feb. 1, 2005

(54) CONDENSATION EVACUATING WINDOW SILL

(76) Inventor: Normand Lapierre, 12995, du Parc, Mirabel, Quebec (CA), J7J 1P3

( * ) Notice: Subject to any disclaimer, the term of this patent is extended or adjusted under 35 U.S.C. 154(b) by 0 days.

(21) Appl. No.: 10/459,496

(22) Filed: Jun. 12, 2003

(65) Prior Publication Data

US 2003/0230034 A1 Dec. 18, 2003

(30) Foreign Application Priority Data

Jun. 12, 2002 (GB) ..... 0213456

(51) Int. Cl.[7] ..... E06B 3/988

(52) U.S. Cl. ..... 52/204.53; 52/209; 52/204.6; 52/204.7; 52/717.01

(58) Field of Search ..... 52/209, 204.53, 52/204.54, 204.6, 204.67, 204.7, 717.01, 204.64

(56) References Cited

U.S. PATENT DOCUMENTS 3,638,372 A * 2/1972 Rosenthal ..... 52/97
5,836,119 A * 11/1998 Emmanuel ..... 52/204.71
5,836,120 A * 11/1998 DeBower ..... 52/209
6,170,207 B1 * 1/2001 Saindon ..... 52/204.2

FOREIGN PATENT DOCUMENTS

DE 2117139 A1 * 2/1982
GB 2041050 A * 9/1980
GB 2209787 A * 5/1989
GB 2227275 A * 7/1990

* cited by examiner

*Primary Examiner*—Peter M. Cuomo
*Assistant Examiner*—Joseph Edell

(57) ABSTRACT

A condensation evacuating sill for evacuating condensate having formed on an inner surface of a window pane includes a molding strip and an attachment extrusion for attaching the molding strip to the window frame. The attachment extrusion includes an extrusion-to-molding attachment section for attaching the molding attachment surface to the attachment extrusion and an extrusion-to-frame attachment section for attaching the attachment extrusion to the window frame. The attachment extrusion is configured and sized for attaching the molding strip to the window frame so that the molding inner edge is spaced relative to the inner surface by a pane-to-molding spacing allowing the condensate to flow therethrough without contacting the molding strip. The attachment extrusion further includes flow guiding components for guiding the flow of condensate from the pane-to-molding spacing to a discharge location located away from the attachment extrusion.

18 Claims, 3 Drawing Sheets

16
12
14
10
28
74
68
56
108
102
92
90
122
132
124
42
32
48
18

10
14
52
56
58
68
70
72
74
76
78
82
88
90
92
94
96
98
102
104
108
110
112
114
116
118
120
122
124
126
128
130
132

CONDENSATION EVACUATING WINDOW SILL

The present invention relates to the general field of window accessories and is particularly concerned with a condensation evacuating window sill.

BACKGROUND OF THE INVENTION

Water vapor is normally present in a gaseous state in the rooms of buildings. The water vapor forms as liquid condensation upon contact with the interior surfaces of a room having a surface temperature sufficiently cool to allow the vapor to transform in its liquid state.

Typically, the condensation appears during the colder winter months when the warm and moist air inside the building strikes the colder glass surfaces of doors and windows chilled by the outside air. The condensate forming on the glass surfaces of doors and windows accumulates on the interior surface of the glass. The condensate then flows downward under the action of gravity. Eventually, the condensate reaches the window sill.

There exists a current trend towards so-called "cocooning" when individuals spend a greater amount of time indoors and more particularly in their homes. Concurrently, some home owners put considerable efforts in trying to transform their homes into warm and cozy living spaces. Accordingly, there exists a trend towards using "natural" products for home furnishings and decorations. For example, window jambs and sills made of wood instead of vinyl or other products is becoming increasingly popular.

When the condensation accumulating on a glass surface of a window flows downwardly upon the adjacent window sill, it eventually impregnates the wood leading to rotting of the latter. In addition, the porous wood also helps bacteria found in molds and mildew to flourish and spread. The presence of mildew and molds can potentially lead to allergies and other health hazards.

Condensation flowing upon the window sill may also run off unto the adjacent paint or wallpaper below and eventually unto the flooring such as carpet or wood flooring. The condensate also sometimes comes into contact with draperies or curtains covering a window causing staining and further mildew.

It has been known in the prior art that it would be advantageous to channel the flow of condensate formed on the interior surfaces of a building such as the interior surface of a window to dispose of it in such a manner as to eliminate water damage. Some prior art attempts to handle the accumulation of condensation have include the protection of some of the property frequently damaged such as draperies with a water proofing material, such as a plastic liner. The plastic liner prevents the draperies from coming into direct contact with the condensation.

There is also known a solution that included a flat wooden board mounted on a window sill. The flat wooden board has channels formed therein. The channels which deepen towards an end of the board have an aperture for the condensate to flow into a detachable receptacle such as a small metal can. The device however requires periodic attention to discharge the accumulated condensation within the receptacle. Also, it has been known to deter the overall aesthetical aspect of the window frame. Accordingly, there exists a need for a window condensate evacuation structure.

SUMMARY OF THE INVENTION

It is a general object of the present invention to provide an improve condensation evacuating window sill.

Advantages of the present invention include that the proposed structure allow evacuation of condensate from the interior surface of a window to a location situated outside the building. Also, the proposed structure reduces the risks of creating unnecessary wind drafts within the interior of the room in which the window is installed.

Furthermore, the proposed structure is designed so as to be mountable to a window frame structure without requiring special tooling or manual dexterity and through a set of quick and ergonomic steps. Still furthermore, the proposed structure is designed so as to be readily customizable to a wide variety of window styles and sizes.

Also, the proposed structure is designed so as to be complimentary or of a pleasing appearance so as to prevent deterioration and even improve on the overall aesthetical appearance of the window and associated window frame. Still furthermore, the proposed structure is designed so as to be easily manufacturable through conventional manufacturing processes such as extrusion so as to provide a structure that will be economically feasible, long lasting and relatively trouble free in operation.

In accordance with the present invention, there is provided a condensation evacuating sill for evacuating condensate having formed on an inner surface of a window pane, the window pane being supported by a window frame, the window frame including an inner frame segment positioned inwardly relative to the inner surface, the sill comprising: a molding strip, the molding strip defining a molding outer edge and a substantially opposed molding inner edge; the molding strip also defining a molding attachment surface positioned substantially between the molding inner and outer edges; an attachment extrusion for attaching the molding strip to the window frame, the attachment extrusion including an extrusion-to-molding attachment section for attaching the molding attachment surface to the attachment extrusion; the attachment extrusion also including an extrusion-to-frame attachment section for attaching the attachment extrusion to the window frame; the attachment extrusion being configured and sized to attach the molding strip to the window frame so that the molding inner edge is spaced relative to the inner surface by a pane-to-molding spacing allowing the condensate to flow therethrough without contacting the molding strip; the attachment extrusion further including flow guiding means for guiding the flow of condensate from the pane-to-molding spacing to a discharge location located away from the attachment extrusion.

Conveniently, the extrusion-to-molding attachment section includes a first attachment leg and a second attachment leg both extending substantially outwardly from the attachment extrusion, the first and second attachment legs being spaced from each other by a spacing segment; the molding attachment surface being provided with a first leg receiving recess and a second leg receiving recess for respectively lockingly receiving the first and second attachment legs; the spacing segment being resiliently bendable between an unbiased locking configuration wherein the first and second attachment legs are respectively inserted in the first and second leg receiving recesses for locking the molding strip to the attachment extrusion and a biased configuration wherein the first and second attachment legs are positioned so as to allow insertion thereof into and withdrawal thereof from respectively the first and second leg receiving recesses. Typically, the molding attachment surface and the spacing segment are substantially complimentarely shaped so that at least a portion of the molding attachment surface and the spacing segment are in abutting contact with each other when the spacing segment is in the unbiased locking configuration.

BRIEF DESCRIPTION OF THE DRAWINGS

An embodiment of the present invention will now be disclosed, by way of example, in reference to the following drawings in which.

DETAILED DESCRIPTION

Figure 1:
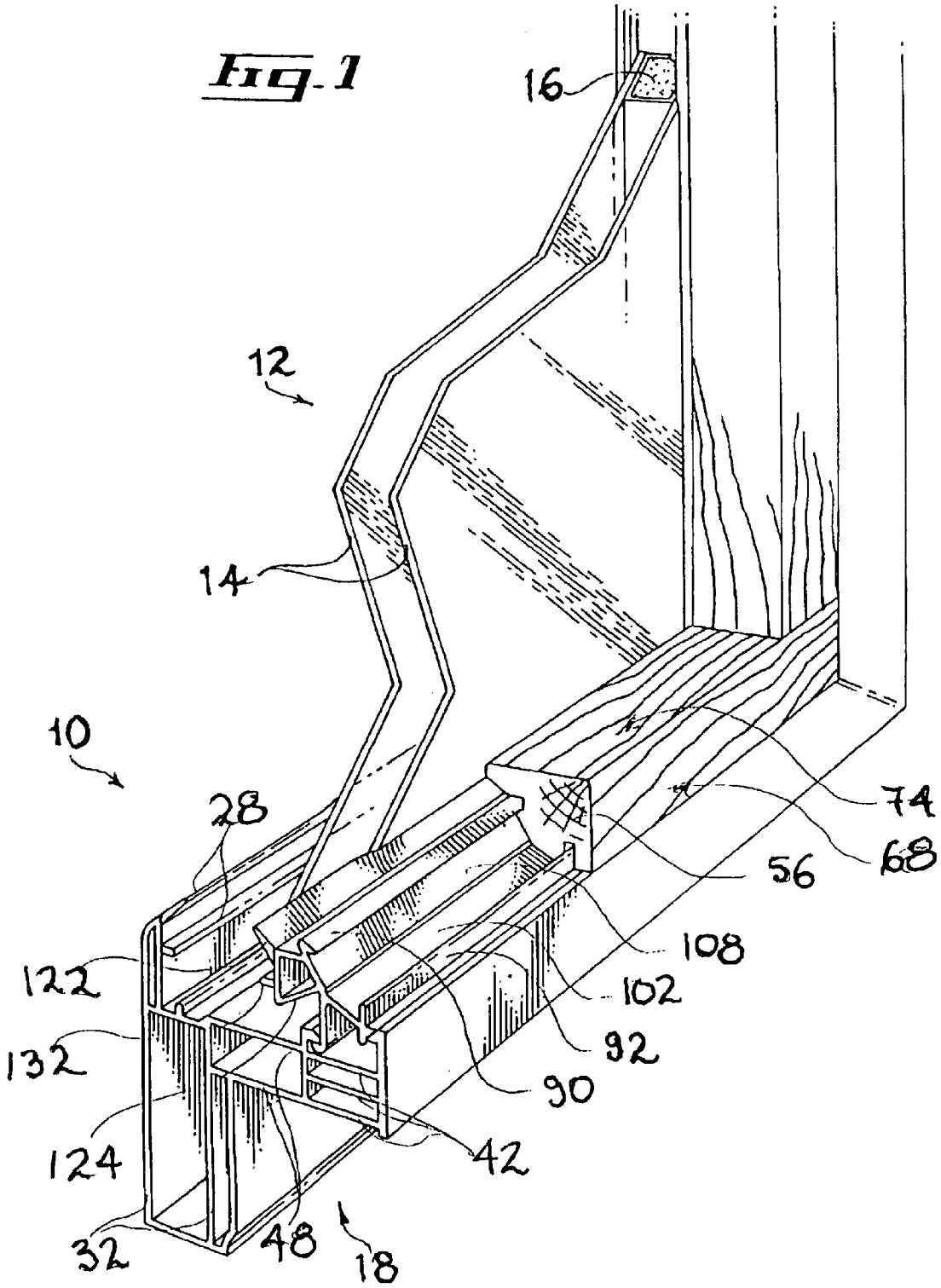
FIG. 1: in a partial perspective view with sections taken out, illustrates a condensation evacuating sill in accordance with an embodiment of the present invention, the sill being shown used adjacent a conventional double pane window.

Referring to FIG. 1, there is shown a condensation evacuating window sill 10 in accordance with an embodiment of the present invention. The window sill 10 is shown mounted adjacent a conventional double pane-type window 12 including a pair of glass panes 14 maintained in a substantially parallel and spaced relationship relative to each other by a conventional pane peripheral insulating and spacing component 16.

Both the window sill 10 and the window 12 are shown mounted to a conventional window frame 18. It should, however, be understood that the window sill 10 could be used in other contexts such: as with other types of windows and/or other types of window frames without departing from the scope of the present invention.

Figure 2:
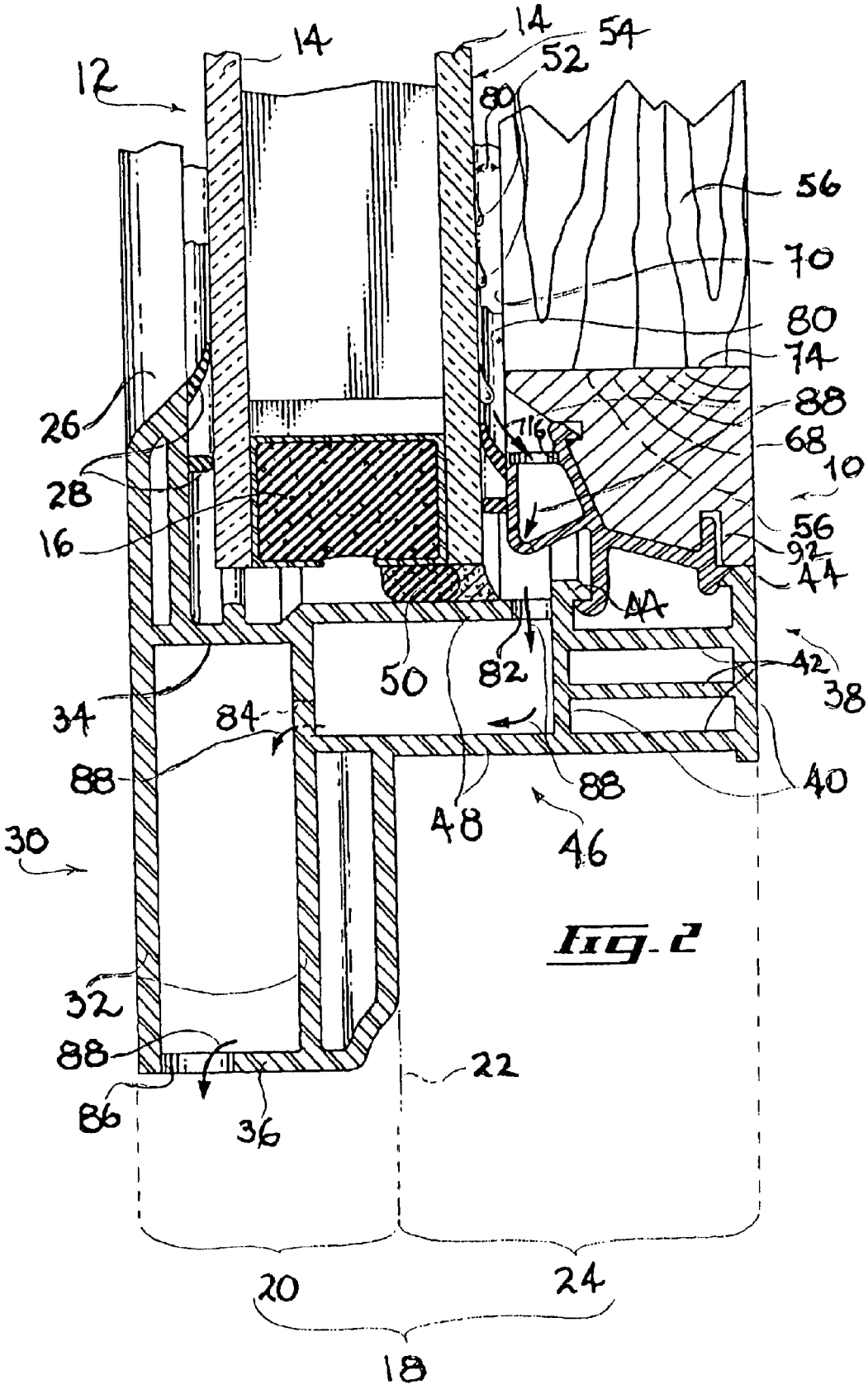
FIG. 2: in a transversal cross-sectional view with sections taken out, illustrates the condensation evacuating window sill shown in FIG. 1 mounted adjacent the double pane window.

As shown more specifically in FIG. 2, the window frame 18 typically includes a frame exterior portion 20 adapted to be positioned outside relative to a reference line 22 schematically representing the exterior surface of a building wall (not shown). The window frame 18 also defines an inner portion 24 adapted to be positioned inwardly relative to the reference 22.

The frame outer portion 20 typically includes a frame peripheral flange 26 for abuttingly contacting an outer surface of the window 12. The frame outer flange 26 is typically provided with at least one and preferably a pair of sealing lips 28 made out of a substantially resilient material such as an elastomeric resin to form a seal against the corresponding exterior pane 14.

The window exterior portion 20 typically also includes an exterior sill 30 mounted at the foot of the window 12 exteriorly relative to the reference line 22. The exterior sill 30 typically includes a pair of exterior sill main walls 32 maintained in a spaced apart relationship relative to each other by a first and a second exterior sill auxiliary walls 34, 36.

The frame interior portion 24 typically includes a sill attachment section 38 for allowing attachment thereto of the interior window sill 10. The still attachment section 38 typically includes a pair of interior sill main walls 40 maintained in a substantially parallel and spaced relationship relative to each other by a set of interior sill auxiliary walls 42. Each interior sill main wall 40 is typically provided with a corresponding substantially hook-shaped attachment end 44 for attachment to the window sill 10.

The window frame 18 further typically includes a window supporting section 46 extending between the window frame exterior and interior portions 20, 24. The frame supporting section 46 typically includes a pair of main supporting walls 48 maintained in a substantially parallel and spaced apart relationship relative to each other by a corresponding exterior sill main wall 32 and a corresponding interior sill auxiliary wall 40. A sealing component 50 is typically sandwiched between the pane spacing component 16 and an adjacent main supporting wall 48.

Again, it should be understood that the window frame 18 shown through the figures is only disclosed by way of example and that the window sill 10 could be used with other types of window frames without departing from the scope of the present invention.

Figures 3, 4:
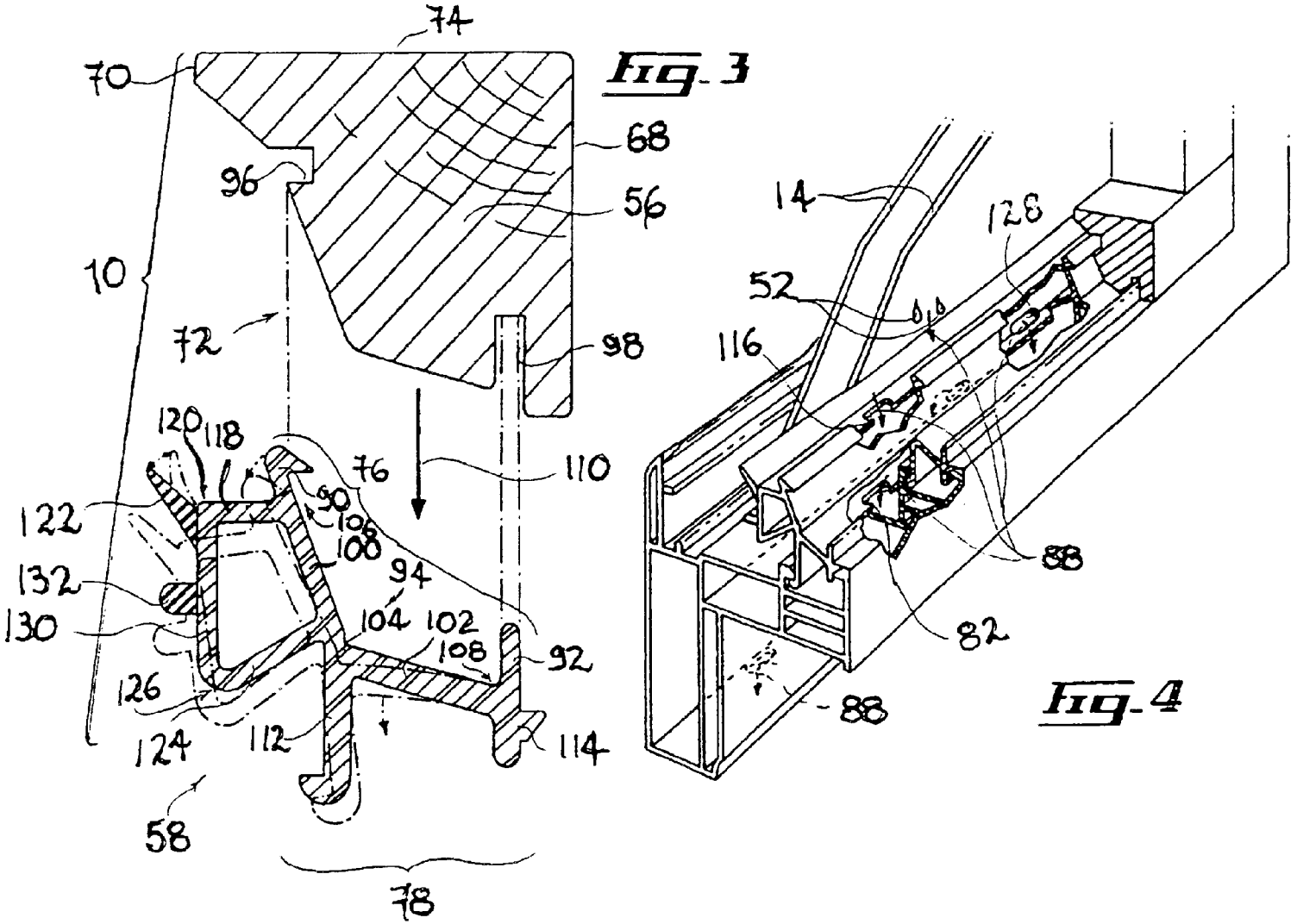
FIG. 3: in a partial transversal cross-sectional view with sections taken out, illustrates a moulding strip about to be attached to an attachment extrusion, both the moulding strip and attachment extrusion being part of the condensation window sill shown in FIGS. 1 and 2.
FIG. 4: in a partial perspective view with sections taken out, illustrates the condensation evacuating window sill shown in FIGS. 1 through 3 with sections removed illustrating the flow path of condensate.

As shown more specifically in FIGS. 2 and 4, the window sill 10 is typically provided for evacuating condensate typically in the form of droplets 52 having formed on the inner surface 54 of the interior window pane 14.

Referring now more specifically to FIG. 3, there is shown in greater details some of the features of the window sill 10. The window sill 10 typically includes a moulding strip 56 and an attachment extrusion 58 for attaching the moulding strip 56 to the window frame 18. The moulding strip 56 defines a moulding outer edge or surface 68 and a substantially opposed moulding inner edge or surface 70. The moulding strip 56 also defines a moulding attachment surface 72 positioned substantially between the moulding inner and outer edges 68, 70.

In the embodiment shown through the figures, the moulding strip 56 is shown as having a substantially flat top surface 74 and a substantially flat inner edge or surface 68. Also, the moulding strip 56 is shown as being made out of wood. It should, however, be understood that the moulding strip 56 could have other configurations as, for example, being provided with ornamental features on the moulding strip top and outer surfaces 74, 68 without departing from the scope of the present invention. Also, even though the window sill 10 is particularly useful in the context of wooden moulding strip 56 so as to prevent deterioration thereof by condensate droplets 52, the moulding strip 56 can be made out of other materials without departing from the scope of the present invention.

The attachment extrusion 58 typically includes an extrusion-to-moulding attachment section 76 for attaching the moulding attachment surface 72 to the attachment extrusion 58. The attachment extrusion 58 also includes an extrusion-to-frame attachment section 78 for attaching the attachment extrusion 58 to the window frame 18.

As illustrated more specifically in FIG. 2, the attachment extrusion 58 is configured and sized for attaching the moulding strip 56 to the window frame 18 so that the moulding inner edge 70 is spaced relative to the inner surface 54 by a pane-to-moulding spacing 80 allowing the condensate droplets 52 to flow therethrough without contacting the moulding strip 56.

The attachment extrusion 58 is typically further provided with flow guiding means for guiding the flow of condensate from the pane-to-moulding spacing 80 to discharge location located away from the attachment extrusion 58. Typically, although by no means exclusively, the flow guiding means will guide the flow of condensate droplets 52 towards the window frame 18 and the window frame 18 will be provided with suitable discharge apertures extending therethrough for discharging the condensate exteriorly. In one possible embodiment of the invention, the window frame 18 is provided with first, second and third frame discharge apertures 82, 84 and 86 allowing the discharge of the condensate droplets 52 such as indicated schematically by arrows 88.

Referring back to FIG. 3, there is shown that the extrusion-to-moulding attachment section 76 typically includes at least one and preferably both a first and a second attachment leg 90, 92 both extending substantially outwardly from the attachment extrusion 58. The first and second attachment legs 90, 92 are typically spaced from each other by a spacing segment 94.

The moulding attachment surface 72 is typically correspondingly provided with a first leg recess 96 and a second leg receiving recess 98 for respectively lockingly receiving the first and second attachment legs 90, 92. The spacing segment 94 is typically resiliently bendable between an unbiased locking configuration shown in full lines and a biased configuration shown in phantom lines.

In the biased locking configuration, the first and second attachment legs 90, 92 are typically respectively inserted in the first and second leg receiving recesses 96, 98 for locking the moulding strip 56 to the attachment extrusion 58. In the biased configuration, the first and second attachment legs 90, 92 are positioned so as to allow insertion thereof into and withdrawal thereof from respectively the first and second leg receiving recesses 96, 98. In other words, when the moulding strip 56 is attached to the attachment extrusion 58, the spacing segment 94 takes the configuration shown in full lines in FIG. 3 whereas then the attachment extrusion 58 is being attached to or retracted from the moulding strip 56, the spacing segment 94 is bent by a biasing force exerted by the hands of an intended user or a tool towards the configuration shown in phantom lines in FIG. 3.

Typically, the moulding attachment surface 72 and the spacing segment 94 are substantially complementarily shaped so that at least a portion of the moulding attachment surface 72 and the spacing segment 94 are in abutting contact with each other when the spacing segment 94 is in the unbiased locking configuration. Typically, the moulding attachment surface 72 has a substantially convex configuration while the spacing segment 94 has a corresponding substantially concave configuration.

In the embodiment shown throughout the figures, both the moulding attachment surface 72 and the spacing segment 94 have a substantially V-shaped configuration. The spacing segment 94 has a first spacing leg 100 and a second spacing leg 102. The first and second spacing legs 100, 102 merge together about a common spacing nadir 104 and diverge away from each other respectively towards a first spacing end 106 and a second spacing end 108.

The first and second attachment legs 90, 92 are typically complementarily shaped so as to prevent relative displacement between the moulding strip 56 and the attachment extrusion 58 in two substantially perpendicular directions. Also, typically, the first and second attachment legs 90, 92 are respectively inserted into the first and second leg receiving recesses 96, 98.

Typically, the first attachment leg 90 has a substantially hook-shaped configuration while the second attachment leg 92 has a substantially rectilinear configuration. Also, typically, the first and second attachment legs 90, 92 are positioned respectively substantially adjacent the first and second spacing ends 106, 108. The hook-shaped configuration of the first attachment leg 100 to prevent relative displacement between the moulding strip 56 and the attachment extrusion 58 in a direction indicated schematically by arrow 110 while the rectilinear configuration of the second attachment leg 92 is adapted to prevent relative displacement between the moulding strip 56 and the attachment extrusion 58 in a direction perpendicular to the arrow 110.

The extrusion-to-frame attachment section 78 typically includes a third attachment leg 112 extending substantially outwardly from the attachment extrusion 58 in a direction substantially opposite the first and second attachment legs 90, 92. The third attachment leg 112 is typically configured and sized for lockingly contacting the window frame 18 when the spacing segment 94 is in the unbiased locking configuration. Typically, the third attachment leg 112 extends substantially outwardly from the attachment extrusion 58 in a position located substantially adjacent to the spacing nadir 104.

Typically, the extrusion-to-frame attachment section 78 also includes a fourth attachment leg 114 extending substantially outwardly from the attachment extrusion 58 substantially adjacent to the second spacing end 108. The fourth attachment leg 114 is configured and sized for abuttingly contacting the window frame 18 and cooperating with the third attachment leg 112 for securing the attachment extrusion 58 to the window frame 18 when the spacing segment 94 is in the unbiased locking configuration.

Hence, when the spacing segment 94 is in the biased configuration shown in phantom lines in FIG. 3, the configuration of the attachment extrusion 58 is such that it facilitates attachment thereof to both the moulding strip 56 and the window frame 18 whereas when the spacing segment 94 is in the unbiased locking configuration shown in full lines in FIG. 3, the attachment extrusion 58 is lockingly secured both the moulding strip 56 and to the window frame 18.

The flow guiding means typically include at least one and preferably a plurality of first draining apertures 116 formed in the attachment extrusion 58. Typically, the flow guiding means includes a first guiding leg 118 extending substantially outwardly from the first spacing leg 100. The first guiding leg 118 defines a first guiding leg distal end 120 positioned substantially in register with the moulding inner edge 70 such as shown in FIG. 2. The first guiding leg 118 is provided with at least one first drainage aperture 116 extending therethrough.

The flow guiding means also includes a first guiding lip 122 extending substantially outwardly from the attachment extrusion 58 substantially adjacent to the first guiding leg 118. The first guiding lip 122 is configured and sized for contacting the inner surface 54 of the window pane 14 and extending substantially across the pane-to-moulding spacing 80 for guiding the condensate 52 from the inner surface 54 of the window pane 14 to at least one of the first drainage apertures 116.

Typically, the flow guiding means also includes as second guiding leg 124 extending substantially outwardly from the spacing segment 94 at least substantially adjacent to the spacing nadir 104. The second guiding 124 defines a second guiding leg distal end 126 positioned substantially in register with the moulding inner edge 70. The second guiding leg typically has at least one and preferably a plurality of second draining apertures 128 extending therethrough.

As illustrated more specifically in FIG. 4, the first second draining apertures 116, 128 are preferably positioned in substantially staggered relationship relative to each other. The staggered relationship between the first and second draining apertures 116, 128 is intended to slow the flow of the condensate droplets 52 hence allowing accumulation thereof so as to promote evaporation. Also, the staggered relationship between the first and second drainage apertures 116, 18 prevents wind drafts from flowing directly inwardly through the first and second drainage apertures 116, 128.

Referring back to FIG. 3, there is shown that the attachment extrusion 58 typically further includes a linking leg 130 extending between the first and second guiding legs 118, 124 substantially adjacent respectively to the first and second guiding leg distal ends 120, 126. The guiding means typically further includes a second guiding lip 132 extending substantially outwardly from the linking leg 130. The second guiding leg(or lip ?) 132 is configured and sized for abuttingly contacting the inner surface 54 of the window pane 14 when the spacing segment 94 is in the unbiased configuration.

In use, as illustrated in FIG. 2, condensate droplets 52 forming on the interior surface 54 of the interior window pane 14 will flow downwardly on the interior surface 54 until reaching the pane-to-moulding spacing 80. The pane-to-moulding spacing 80 prevents the droplets 52 from contacting the moulding strip 56 and, hence, damaging the latter.

The droplets 52 flowing downwardly past the moulding inner edge 70 are adapted to be guided by the first guiding lip 122 towards the first drainage apertures 116. The droplets 52 flowing through the first drainage apertures 116 accumulate on the second guiding leg 124 because of the hereinabove mentioned staggered relationship before flowing through the second draining apertures 128. Once the droplets 52 have dropped away from the attachment extrusion 58, they may be either collected or, as shown throughout the figures, discharged through corresponding first, second and third draining apertures 82, 84 and 86 exteriorly relative to the window 12.

The embodiments of the invention in which an exclusive privilege or property is claimed are defined as follows:

1. A condensation evacuating sill for evacuating condensate having formed on an inner surface of a window pane, said window pane being supported by a window frame, said window frame including an inner frame segment positioned inwardly relative to said inner surface, said sill comprising:

a molding strip, said molding strip defining a molding outer edge and a substantially opposed molding inner edge; said molding strip also defining a molding attachment surface positioned substantially between said molding inner and outer edges;

an attachment extrusion for attaching said molding strip to said window frame, said attachment extrusion including an extrusion-to-molding attachment section for attaching said molding attachment surface to said attachment extrusion; said attachment extrusion also including an extrusion-to-frame attachment section for attaching said attachment extrusion to said window frame; said attachment extrusion being configured and sized to attach said molding strip to said window frame so that said molding inner edge is spaced relative to said inner surface by a pane-to-molding spacing allowing said condensate to flow therethrough without contacting said molding strip; said attachment extrusion further including flow guiding means for guiding the flow of said condensate from said pane-to-molding spacing to a discharge location located away from said attachment extrusion.

2. A condensation evacuating sill as recited in claim 1 wherein said extrusion-to-molding attachment section includes at least one attachment leg extending substantially outwardly from said attachment extrusion, said at least one attachment leg being coupled to a spacing segment; said molding attachment surface being provided with at least one leg receiving recess for lockingly receiving said at least one attachment leg; said spacing segment being resiliently bendable between an unbiased locking configuration wherein said at least one attachment leg is inserted in said at least one leg receiving recess for locking said molding strip to said attachment extrusion and a biased configuration wherein said at least one attachment leg is positioned so as to allow insertion thereof into and withdrawal thereof from said at least one leg receiving recess.

3. A condensation evacuating sill as recited in claim 1 wherein said extrusion-to-molding attachment section includes a first attachment leg and a second attachment leg both extending substantially outwardly from said attachment extrusion, said first and second attachment legs being spaced from each other by a spacing segment; said molding attachment surface being provided with a first leg receiving recess and a second leg receiving recess for respectively lockingly receiving said first and second attachment legs; said configuration wherein said first and second attachment legs are respectively inserted in said first and second leg receiving recesses for locking said molding strip to said attachment extrusion and a biased configuration wherein said first and second attachment legs are positioned so as to allow insertion thereof into and withdrawal thereof from respectively said first and second leg receiving recesses.

4. A condensation evacuating sill as recited in claim 3 wherein said molding attachment surface and said spacing segment are substantially complimentarely shaped so that at least a portion of said molding attachment surface and said spacing segment are in abutting contact with each other when said spacing segment is in said unbiased locking configuration.

5. A condensation evacuating sill as recited in claim 4 wherein said molding attachment surface has a substantially convex configuration and said spacing segment has a corresponding substantially concave configuration.

6. A condensation evacuating sill as recited in claim 5 wherein said molding attachment surface and said spacing segment both have a substantially 'V'-shaped configuration, said spacing segment having a first spacing leg and a second spacing leg, said first and second spacing legs merging together about a common spacing nadir and diverging away from each other respectively towards a first spacing end and a second spacing end.

7. A condensation evacuating sill as recited in claim 6 wherein said extrusion-to-frame attachment section includes a third attachment leg extending substantially outwardly from said attachment extrusion substantially adjacent to said spacing nadir and in a direction substantially opposite to said first and second attachment legs, said third attachment leg being configured and sized for lockingly contacting said window frame when said spacing segment is in said unbiased locking configuration.

8. A condensation evacuating sill as recited in claim 7 wherein said extrusion-to-frame attachment section also includes a fourth attachment leg extending substantially outwardly from said attachment extrusion substantially adjacent to said second spacing end, said fourth attachment leg being configured and sized for abuttingly contacting said window frame and cooperating with said third attachment leg for securing said attachment extrusion to said window frame when said spacing segment is in said unbiased locking configuration.

9. A condensation evacuating sill as recited in claim 6 wherein said flow guiding means includes a first guiding leg extending substantially outwardly from said first spacing leg; said first guiding leg defining a first guiding leg distal end positioned substantially in register with said molding inner edge, said first guiding leg having at least one first draining aperture extending therethrough, said flow guiding means also including a first guiding lip extending substantially outwardly from said attachment extrusion substantially adjacent to said first guiding leg, said first guiding lip being configured and sized for contacting said inner surface of said window pane and extending substantially across said pane-to-molding spacing for guiding said condensate from said inner surface of said window pane to said at least one first draining aperture.

10. A condensation evacuating sill as recited in claim 9 wherein said flow guiding means also includes a second guiding leg extending substantially outwardly from sold spacing segment substantially adjacent to said spacing nadir, said second guiding leg defining a second guiding leg distal end positioned substantially in register with said molding inner edge, said second guiding leg having at least one second draining aperture extending therethrough.

11. A condensation evacuating sill as recited in claim 10 herein said first and second guiding logs are provided respectively with a plurality of first and second draining apertures extending therethrough, said first and second draining apertures being in a substantially staggered relationship relative to each other.

12. A condensation evacuating sill as recited in claim 11 further comprising a linking leg extending between said first and second guiding legs substantially adjacent respectively to said first and second guiding leg distal ends; said guiding means further including a second guiding lip extending substantially outwardly from said linking leg; said second guiding lip being configured and seed for abuttingly contacting said inner surface of said window pane when said spacing segment is in said unbiased locking configuration.

13. A condensation evacuating sill as recited in claim 3 wherein said first and second attachment legs are complementarely shaped so as to prevent relative displacement between said molding strip and attachment extrusion in two substantially perpendicular directions when said first and second attachment legs are respectively inserted into said first and second leg receiving recesses.

14. A condensation evacuating sill as recited in claim 13 wherein said first attachment leg has a substantially hook-shaped configuration and said second attachment leg has a substantially rectilinear configuration; said first and second attachment legs being positioned respectively substantially adjacent said first and second spacing ends.

15. A condensation evacuating sill as recited in claim 3 wherein said extrusion-to-frame attachment section includes a third attachment leg extending substantially outwardly from said attachment extrusion in a direction substantially opposite to said first and second attachment legs, said third attachment leg being configured and sized for lockingly contacting said window frame when said spacing segment is in said unbiased locking configuration.

16. A condensation evacuating sill as recited in claim 1 wherein said flow guiding means includes at least one first draining aperture formed in said attachment extrusion, said flow guiding means also including a first guiding lip extending substantially outwardly from said attachment extrusion, said first guiding lip being configured and sized for contacting said inner surface of said window pane and extending substantially across said pane-to-molding spacing for guiding said condensate from said inner surface of said window pane to said at least one first draining aperture.

17. A condensation evacuating sill as recited in claim 16 wherein said first guiding lip is made out of a substantially resiliently deformable material.

18. In combination, a condensation evacuating sill for evacuating condensate having formed on an inner surface of a window pane and a window frame for supporting said window pane, said window frame including an inner frame segment positioned inwardly relative to said inner surface and an outer frame segment positioned, said sill comprising:

a molding strip, said molding strip defining a molding outer edge and a substantially opposed molding inner edge; said molding strip also defining a molding attachment surface positioned substantially between said molding inner and outer edges;

an attachment extrusion for attaching said molding strip to said window frame, said attachment extrusion including an extrusion-to-molding attachment section for attaching said molding attachment surface to said attachment extrusion; said attachment extrusion also including an extrusion-to-frame attachment section for attaching said attachment extrusion to said window frame; said attachment extrusion being configured and sized to attach said molding strip to said window frame so that said molding inner edge is spaced relative to said inner surface by a pane-to-molding spacing allowing said condensate to flow therethrough without contacting said molding strip; said attachment extrusion further including flow guiding means for guiding the flow of ad condensate from said pane-to-molding spacing to a discharge location located away from said attachment extrusion.

* * * * *